US008091992B2

(12) United States Patent
Hanchak

(10) Patent No.: US 8,091,992 B2
(45) Date of Patent: Jan. 10, 2012

(54) DEFLECTION DEVICE INCLUDING GAS FLOW RESTRICTION DEVICE

(75) Inventor: Michael S. Hanchak, Dayton, OH (US)

(73) Assignee: Eastman Kodak Company, Rochester, NY (US)

( * ) Notice: Subject to any disclaimer, the term of this patent is extended or adjusted under 35 U.S.C. 154(b) by 590 days.

(21) Appl. No.: 12/265,111

(22) Filed: Nov. 5, 2008

(65) Prior Publication Data

US 2010/0110149 A1 May 6, 2010

(51) Int. Cl.
*B41J 2/09* (2006.01)

(52) U.S. Cl. ..... 347/77

(58) Field of Classification Search ..... 347/77, 347/73–76, 78–79, 80–83, 90
See application file for complete search history.

(56) References Cited

U.S. PATENT DOCUMENTS

| | | | |
|---|---|---|---|
| 4,068,241 | A | 1/1978 | Yamada |
| 4,097,872 | A | 6/1978 | Giordano et al. |
| 4,297,712 | A | 10/1981 | Lammers et al. |
| 4,672,397 | A | 6/1987 | Suga et al. |
| 5,428,384 | A | 6/1995 | Richtsmeier et al. |
| 5,528,271 | A | 6/1996 | Ebisawa |
| 6,328,442 | B1 | 12/2001 | Brinkly |
| 6,367,906 | B1 | 4/2002 | Hiramatsu et al. |
| 6,390,618 | B1 | 5/2002 | Wotton et al. |
| 6,457,807 | B1 | 10/2002 | Hawkins et al. |
| 6,463,674 | B1 | 10/2002 | Myers et al. |
| 6,491,362 | B1 | 12/2002 | Jeanmaire |
| 6,505,921 | B2 | 1/2003 | Chwalek et al. |
| 6,554,389 | B1 | 4/2003 | Hawkins et al. |
| 6,554,410 | B2 | 4/2003 | Jeanmaire et al. |
| 6,575,566 | B1 | 6/2003 | Jeanmaire et al. |
| 6,588,888 | B2 | 7/2003 | Jeanmaire et al. |
| 6,793,328 | B2 | 9/2004 | Jeanmaire |
| 6,827,429 | B2 | 12/2004 | Jeanmaire et al. |
| 6,851,796 | B2 | 2/2005 | Jeanmaire et al. |
| 7,686,435 | B2 * | 3/2010 | Gao et al. ..... 347/77 |
| 2003/0016276 | A1 | 1/2003 | Jeanmaire |

* cited by examiner

*Primary Examiner* — Kristal Feggins
(74) *Attorney, Agent, or Firm* — William R. Zimmerli

(57) ABSTRACT

A continuous inkjet printhead includes a jetting module including a nozzle operable to eject a continuous stream of fluid through the nozzle, a stimulation device operable to break the stream of fluid into first and second droplets having first and second volumes, wherein the droplet volumes travel along a first path, and a drop deflection mechanism that includes a gas flow path, a first flow path restriction positioned within the flow path, and a second flow path restriction positioned within the flow path, the second flow path restriction being non-parallel relative to the first flow path restriction, the drop deflection mechanism providing a gas flow which interacts with the first and second droplets to cause at least one of the first and second droplets to begin traveling along a second path.

12 Claims, 9 Drawing Sheets

DEFLECTION DEVICE INCLUDING GAS FLOW RESTRICTION DEVICE

CROSS REFERENCE TO RELATED APPLICATIONS

Reference is made to commonly assigned U.S. patent application Ser. No. 12/265,146 filed concurrently herewith entitled "DEFLECTION DEVICE INCLUDING EXPANSION AND CONTRACTION REGIONS" in the name of Todd R. Griffin et al., incorporated herein by reference.

FIELD OF THE INVENTION

This invention relates generally to the field of digitally controlled printing devices, and in particular to continuous printing systems in which a liquid stream breaks into droplets that are deflected by a gas flow.

BACKGROUND OF THE INVENTION

Printing systems that deflect drops using a gas flow are known, see, for example, U.S. Pat. No. 4,068,241, issued to Yamada, on Jan. 10, 1978.

In printing systems that use gas flow to deflect drops, it is critical to provide a laminar flow of gas in the drop deflection zone so that drop deflection occurs in a predictable manner. Drop deflection or divergence can be adversely affected when turbulence is present in, for example, the interaction area of the drops and the gas flow force. Turbulent gas flow may increase or decrease the angle of drop deflection or divergence for both printed and non-printed drop which may lead to reduced drop placement accuracy, image defects, and poor print quality.

Accordingly, a need exists to reduce turbulent gas flow in printing systems that use gas flow to deflect drops.

SUMMARY OF THE INVENTION

According to one aspect of the invention, a continuous inkjet printhead includes a jetting module, a stimulation device, and a drop deflection mechanism. The jetting module includes a nozzle and is operable to eject a continuous stream of fluid through the nozzle. The stimulation device is operable to break the stream of fluid into first and second droplets, having first and second volumes, respectively. These first and second droplets travel along a first path. The drop deflection mechanism includes a structure which defines a gas flow path, a first flow path restriction positioned along the flow path, and a second flow path restriction positioned along the flow path. The second flow path restriction is non-parallel relative to the first flow path restriction. The drop deflection mechanism provides a gas flow which interacts with the first and second droplets in the drop deflection zone. The interaction between the gas flow and the droplets causes at least one of the first and second droplets to begin traveling along another, second path.

According to another aspect of the invention, a continuous inkjet printhead includes a jetting module, a stimulation device, and a drop deflection mechanism. The jetting module includes a nozzle and is operable to eject a continuous stream of fluid through the nozzle. The stimulation device is operable to break the stream of fluid into first and second droplets, having first and second volumes, respectively. These first and second droplets travel along a first path. The drop deflection mechanism includes a structure which defines a gas flow path, a flow path restriction positioned along the flow path. The flow path restriction is located at the end of the flow path proximate the drop deflection zone and is perpendicular to the gas flow. The drop deflection mechanism provides a gas flow which interacts with the first and second droplets in the drop deflection zone. The interaction between the gas flow and the droplets causes at least one of the first and second droplets to begin traveling along another, second path.

According to another aspect of the invention, a method of deflecting liquid drops includes providing a jetting module, a stimulation device, and a drop deflection mechanism, causing the jetting module to eject a continuous stream of fluid through the nozzle of the jetting module, causing the stimulation device to break the stream of fluid into first and second droplets having first and second volumes which travel along a first path, and causing the drop deflection mechanism to provide a gas flow to interact with the first and second droplets in a drop deflection zone. This interaction causes at least one of the first and second droplets to begin to travel along another, second path. The drop deflection mechanism includes a structure which defines a gas flow path, a first flow path restriction positioned along the flow path, and a second flow path restriction positioned along the flow path. The second flow path restriction is non-parallel relative to the first flow path restriction, and is located between the first flow path restriction and the source of the gas flow.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
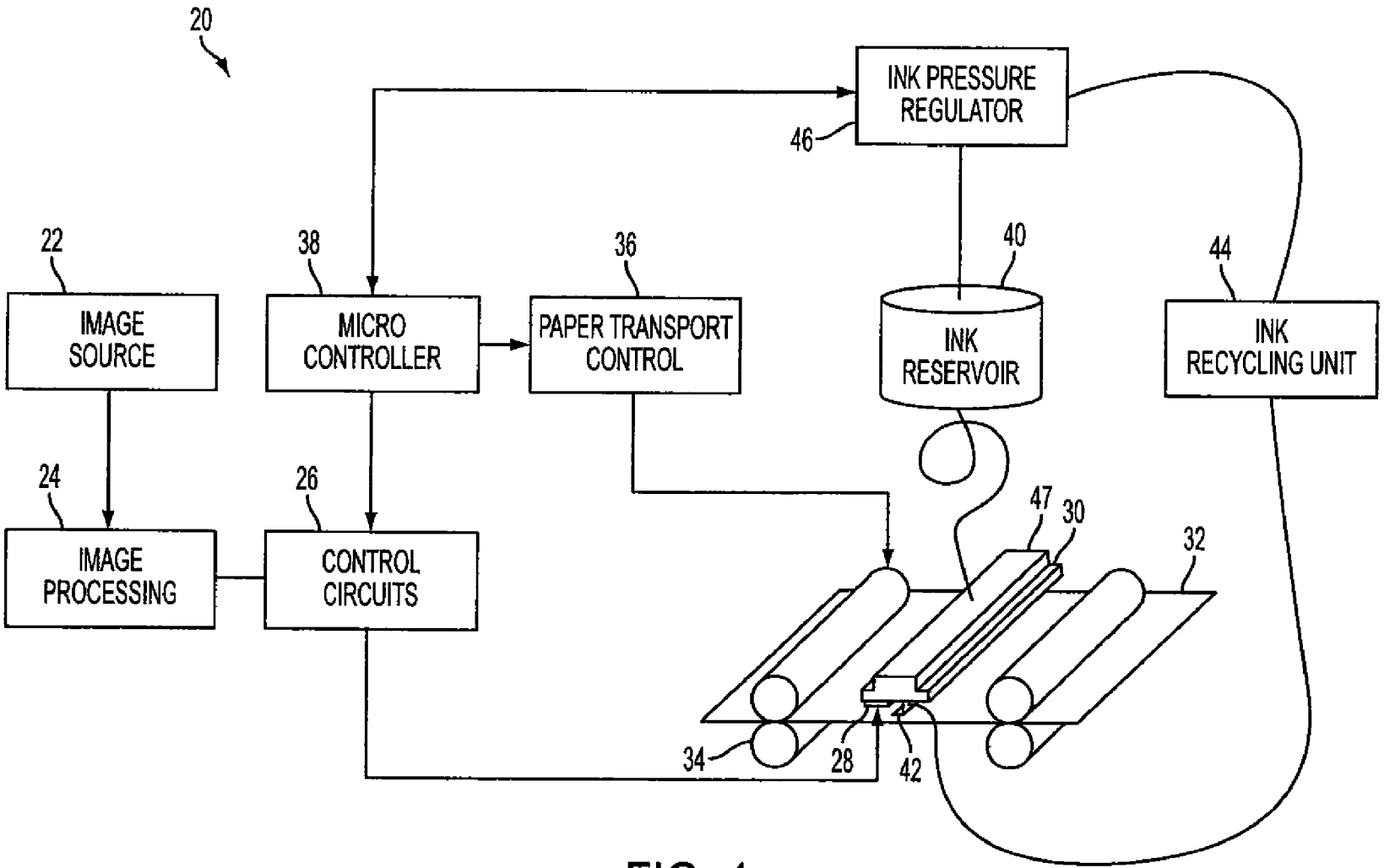
FIG. 1 shows a simplified schematic block diagram of an example embodiment of a printer system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead and/or printhead components typically used in inkjet printing systems. However, many other applications are emerging which use inkjet printheads to emit liquids (other than inks) that need to be finely metered and deposited with high spatial precision. As such, as described herein, the terms "liquid" and/or "ink" refer to any material that can be ejected by the printhead and/or printhead components described below.

Referring to FIG. 1, a continuous printer system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. As shown in FIG. 1, catcher 42 is a type of catcher commonly referred to as a "knife edge" catcher.

The ink is distributed to printhead 30 through an ink channel 47. The ink preferably flows through slots and/or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1) which is described in more detail below with reference to FIGS. 2 and 3.

Figure 2:
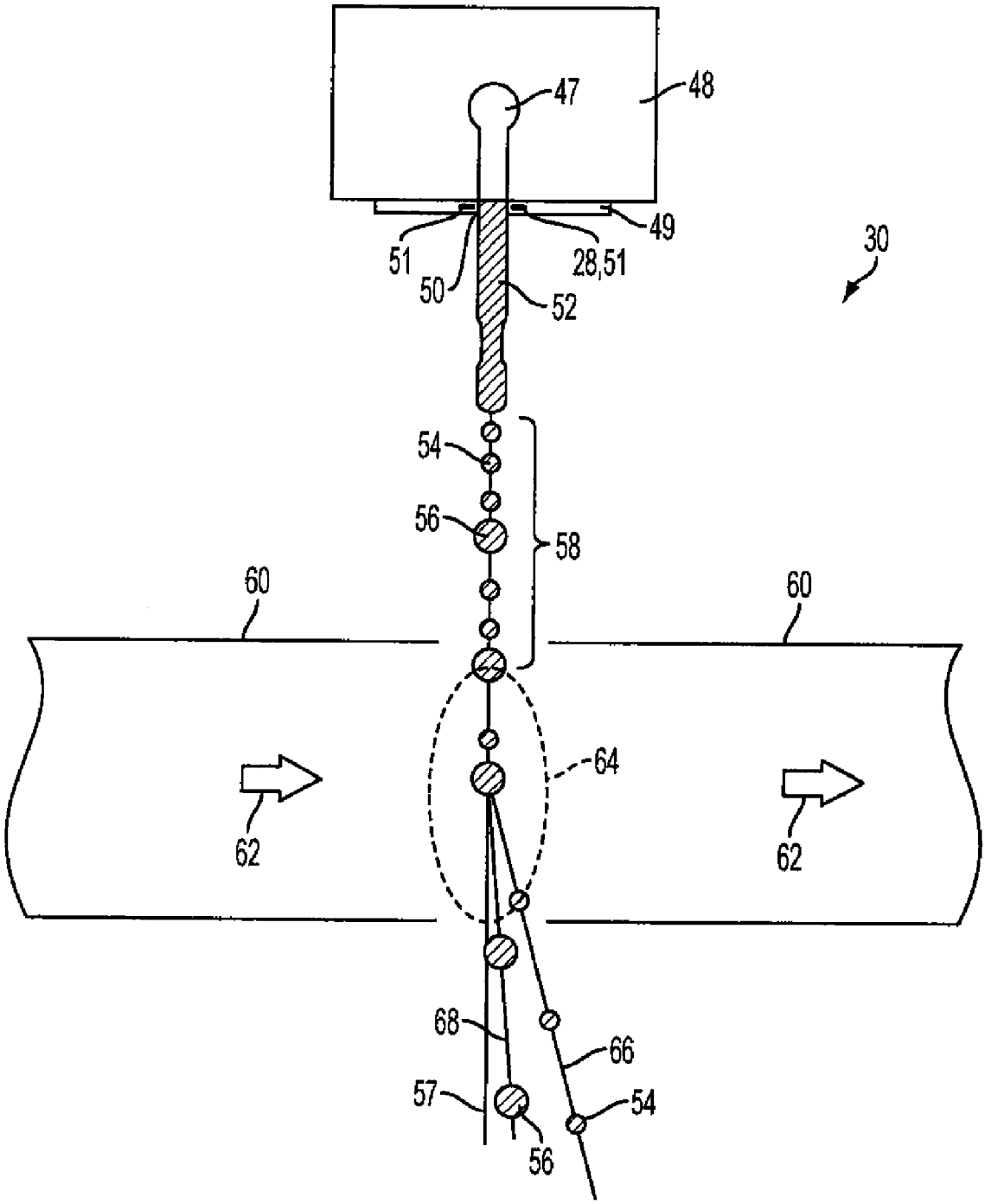
FIG. 2 is a schematic side view of an example embodiment of a continuous printhead made in accordance with the present invention.
Figure 3:
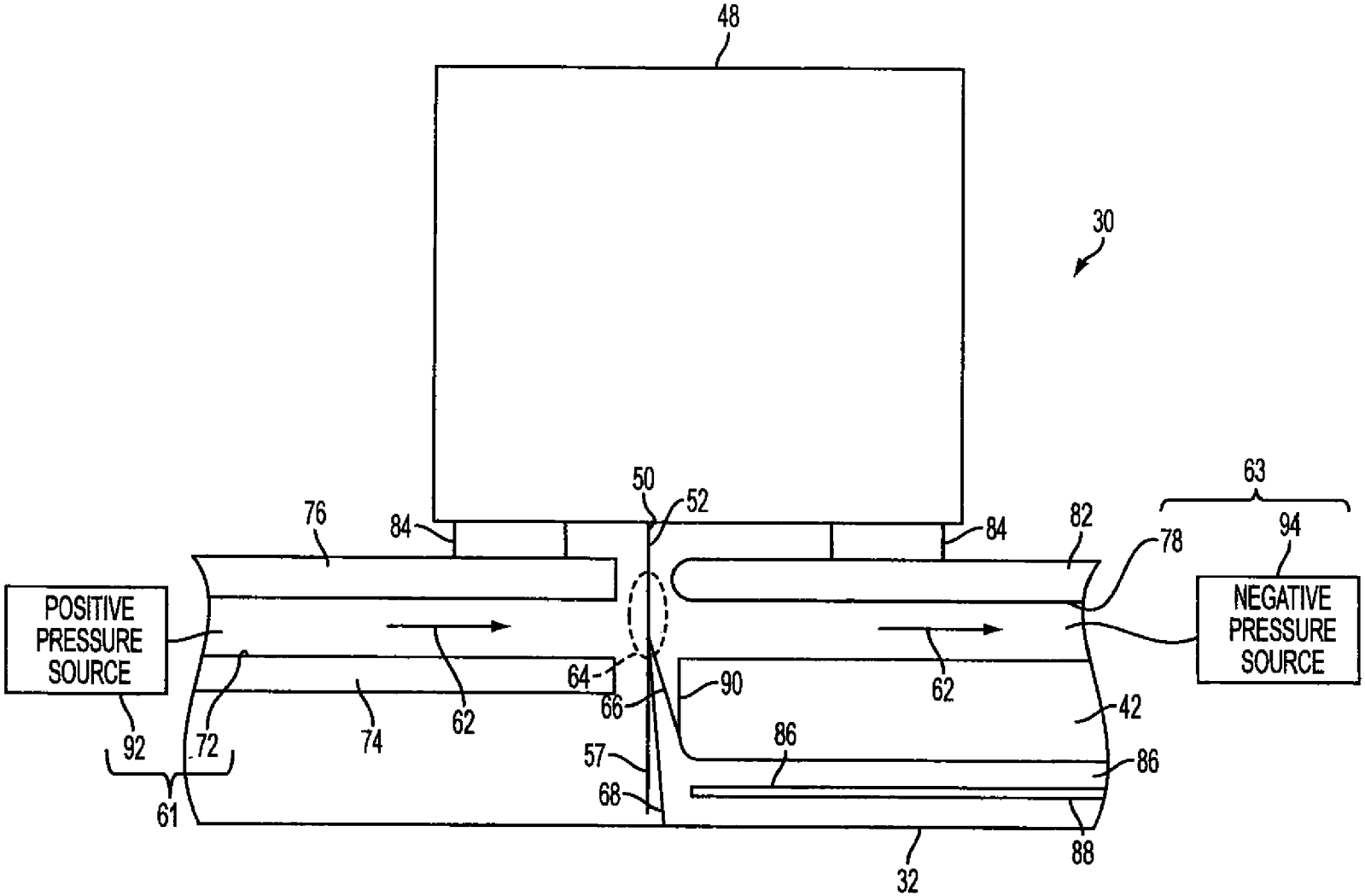
FIG. 3 is a schematic side view of an example embodiment of a continuous printhead made in accordance with the present invention.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be integrally formed with jetting module 48.

Liquid, for example, ink, is emitted under pressure through each nozzle 50 of the array to form filaments of liquid 52. In FIG. 2, the array or plurality of nozzles extends into and out of the figure.

Jetting module 48 is operable to form liquid drops having a first size and liquid drops having a second size through each nozzle. To accomplish this, jetting module 48 includes a drop stimulation or drop forming device 28, for example, a heater or a piezoelectric actuator, that, when selectively activated, perturbs each filament of liquid 52, for example, ink, to induce portions of each filament to breakoff from the filament and coalesce to form drops 54, 56.

In FIG. 2, drop forming device 28 is a heater 51 located in a nozzle plate 49 on one or both sides of nozzle 50. This type of drop formation is known and has been described in, for example, U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005, the disclosures of which are incorporated by reference herein.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56, a first size or volume, and small drops 54, a second size or volume. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike the print media. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47, is emitted under pressure through each nozzle 50 of the array to form filaments of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at an angle θ of approximately 90° relative to liquid filament 52 toward drop deflection zone 64 (also shown in FIG. 2). An optional seal(s) 84 provides an air seal between jetting module 48 and upper wall 76 of gas flow duct 72. Lower wall 74 and upper wall 76 of gas flow duct 72 extend to drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. An optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and work equally well. Alternatively, catcher 42 can be of any suitable design including, but not limited to, a porous face catcher, a delimited edge catcher, or combinations of any of those described above.

Figure 4:
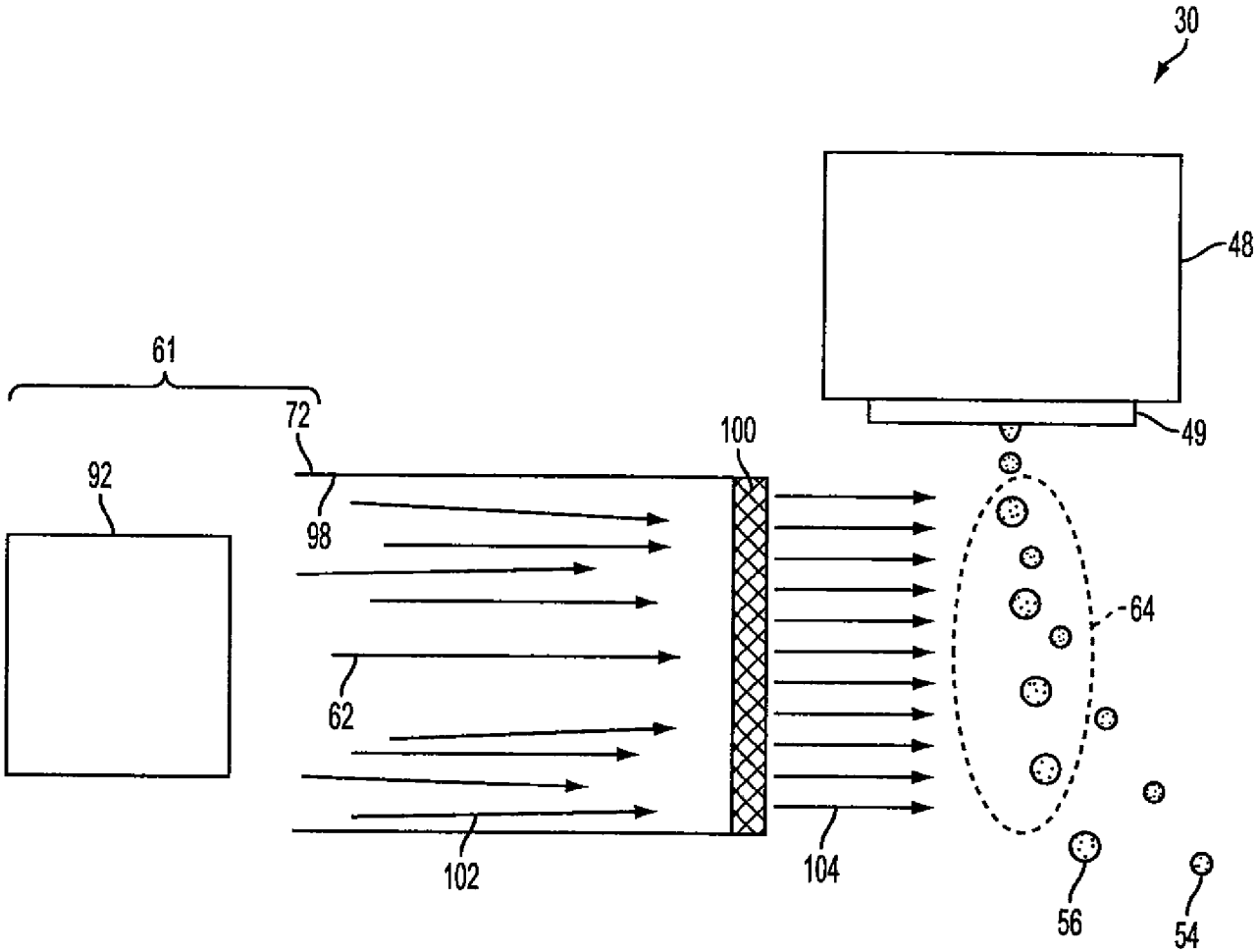
FIG. 4 is a schematic side view of an example embodiment of the present invention including one flow path restriction.

Referring to FIG. 4, an example embodiment of the present invention is shown. Positive pressure gas flow structure 61 of gas flow deflection mechanism 60 includes a flow path restriction 100. Flow path restriction 100 is located at an end of a flow path 98 defined by gas flow duct 72 that is proximate drop deflection zone 64 and spaced apart (or opposite) the end of the flow path 98 that is connected to positive pressure source 92. Flow path restriction 100 is positioned perpendicular to the direction of gas flow 62 (represented by arrow 62).

Flow path restriction 100 helps to control the velocity of gas flow and ensure that the velocity vectors remain pointed in the proper direction. As the gas passes through flow restriction 100, the gas flow 62 is divided into a flow component perpendicular to flow restriction 100 and another flow component parallel to flow restriction 100 which is effectively zero. This changes a non-laminar or turbulent flow of gas 102 into a substantially laminar flow of gas 104 as it exits gas flow duct 72. Laminar gas flow 104 interacts with drops 54 and 56, formed from jetting module 48, in drop deflection zone 64 causing small volume drops 54 to be deflected more than large volume drops 56.

Flow restriction 100 is made of a porous material, such as a woven screen or mesh, either wire, metal, or polymer (plastic). The pores can be located at regular intervals or can be randomly placed, provided that the porosity is relatively uniform across the gas flow duct 72. Fine screen or mesh pores reduce the turbulence more than screen or mesh pores that are coarse. When used as a flow restrictor 100, the screen or mesh pores are typically finer than the pitch of the jets. In FIG. 4, flow restriction 100 is made of a stainless steel screen having approximately 600 lines per inch.

Alternatively, other suitable flow restricting devices or structures, for example, porous plates, foams, and felts, can be used provided they do not cause too large of a pressure drop across the flow restricting device (which reduces the velocity of the gas flow) and do not shed particles (which interferes with drop deflection). Typically, the type of flow restricting device and/or material selection depends on the specific application contemplated.

Figure 5:
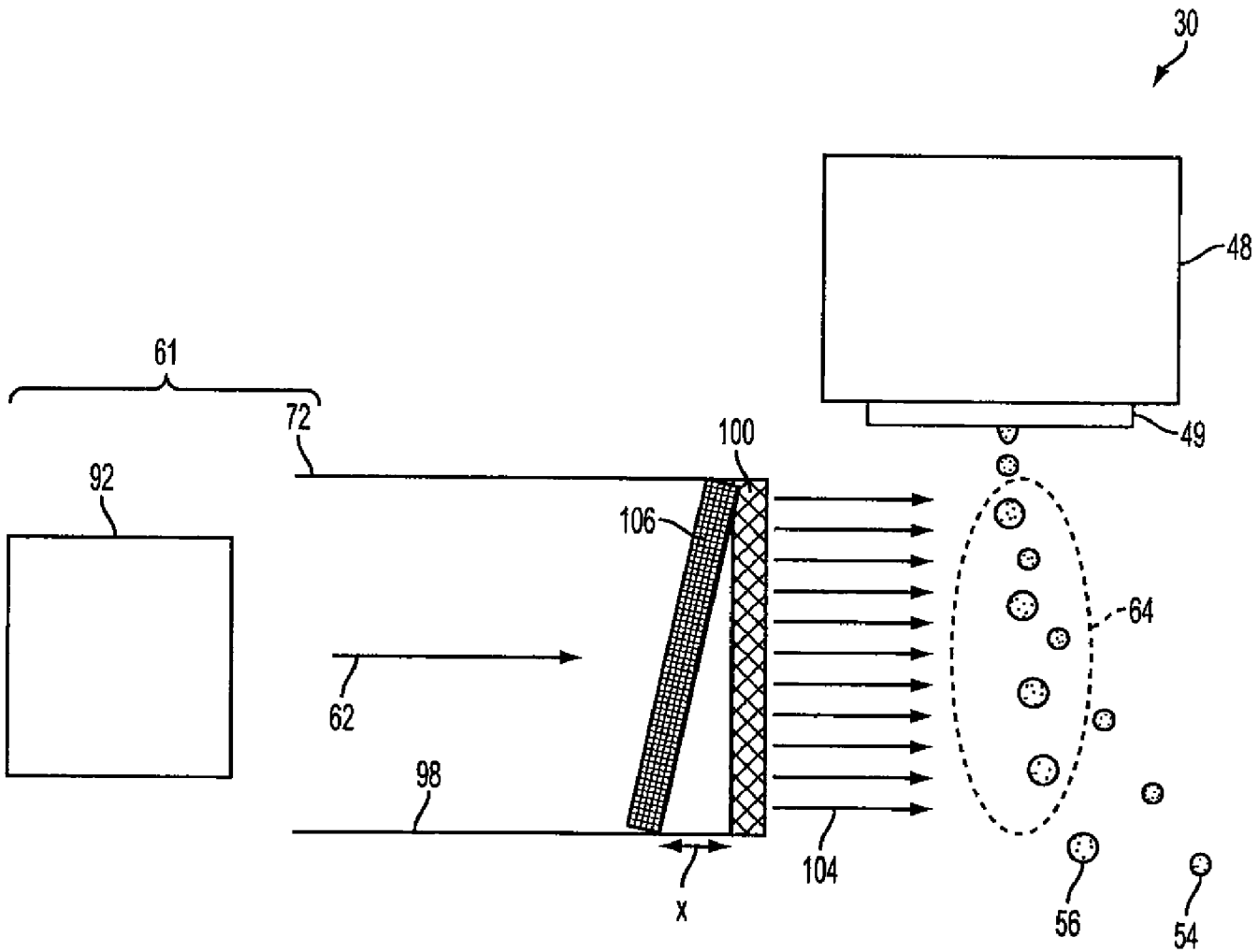
FIG. 5 is a schematic side view of another example embodiment of the present invention including two flow path restrictions.
Figure 6:
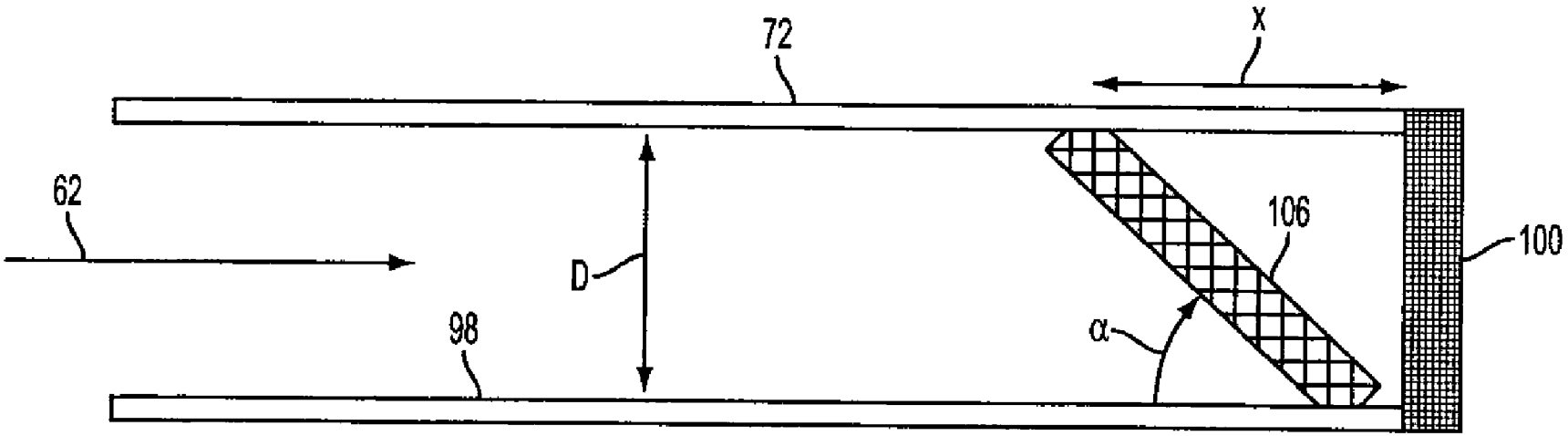
FIG. 6 is a schematic cross-sectional side view of another example embodiment of the present invention including two flow path restrictions.

Referring to FIGS. 5 and 6, another embodiment of the present invention are shown. As shown in FIG. 5, positive pressure gas flow structure 61 of gas flow deflection mechanism 60 includes a flow path restriction 100. Flow path restriction 100 is located at an end of a flow path 98 defined by gas flow duct 72 that is proximate drop deflection zone 64 and spaced apart (or opposite) the end of the flow path 98 that is in fluid communication with or connected to positive pressure source 92. Flow path restriction 100 is positioned perpendicular to the direction of gas flow 62 (represented by arrow 62). Gas flow duct 72 also includes a second flow restriction 106. The positioning or orientation of second flow path restriction 106 is different when compared to the orientation of first flow path restriction 100. Laminar gas flow 104 exiting gas flow duct 72 interacts with drops 54 and 56, formed from jetting module 48, in drop deflection zone 64 causing small volume drops 54 to be deflected more than large volume drops 56.

A cross-section of flow path 98 is shown in FIG. 6. Gas flow duct 72 has a height D and a width (extending in and out of the figure) that is preferably approximately equal to or greater than the length of the nozzle array formed in nozzle or orifice plate 49 (also extending in and out of the figure). Gas flow 62 moves from left to the right in the figure.

First gas flow restriction 100 and second gas flow restrictions 106 have different orientations relative to each other. First flow restriction 100 is perpendicular to the direction of gas flow 62 and is located at the end of the flow path 98 spaced apart from gas flow source 92, and proximate to drop deflection zone 64. Second flow restriction 106 is positioned in flow path 98 between gas flow source 92 and first restriction 100. Second restriction 106 is oriented at angle a relative to a wall of gas flow duct 72 such that second restriction 106 is positioned non-parallel relative to first restriction 100, non-perpendicular relative to gas flow 62, and at a non-parallel, non-perpendicular angle relative to the walls of gas flow duct 72. Angle $\alpha$ can be between 30° and 60°. Preferably, angle $\alpha$ is between 35° and 55°, and more preferably, angle $\alpha$ is 45°.

First restriction 100 and second restriction 106 are separated by a distance X, with X preferably being between one and two times D. Second flow restriction 106 can be positioned such that distance X is located spaced apart from jetting module 48 (at the bottom of gas flow duct 72 as shown in FIG. 5) or proximate jetting module 48 (at the top of gas flow duct 72 as shown in FIG. 6). Alternatively, other orientations can be used depending on the specific application contemplated.

Flow restrictions 100 and 106 are made of a porous material, such as a woven screen or mesh, either metal or polymer. The pores can be located at regular intervals or can be randomly placed, provided that the porosity is relatively uniform across the gas flow duct 72. Fine screen or mesh pores reduce the turbulence more than screen or mesh pores that are coarse. When used as a flow restrictor 100, the screen or mesh pores are typically finer than the pitch of the jets. First and second flow path restrictions 100 and 106 can be made of the same material or different materials depending on the application contemplated. In FIGS. 5 and 6, flow restrictions 100 and 106 are made of a stainless steel screen having approximately 600 lines per inch.

Alternatively, other suitable flow restricting devices or structures, for example, porous plates, foams, and felts, can be used provided they do not cause too large of a pressure drop across the flow restricting device (which reduces the velocity of the gas flow) and do not shed particles (which interferes with drop deflection). Typically, the type of flow restricting device and/or material selection depends on the specific application contemplated.

Flow path restriction 106 (with a non-perpendicular orientation relative to gas flow 62) reduces turbulence in the main direction of the gas flow 62 while flow path restriction 100 (with a perpendicular orientation relative to gas flow 62) helps to control the velocity of the gas flow and ensure that the velocity vectors remain pointed in the proper direction.

Each time the gas flows or passes through a restriction, the gas flow is split into a component perpendicular to the restriction and another component parallel to the restriction which is effectively zero. While all gas flow is split into these two components, when turbulent gas flow is present, the turbulent flow components perpendicular to the restriction are reduced in magnitude while maintaining the overall gas flow rate.

Accordingly, additional flow path restrictions can further minimize turbulent components and many combinations of perpendicular and non-perpendicular restrictions can be used to obtain the desired laminar flow depending on the application contemplated. Example embodiments illustrating this aspect of the invention are described below.

Figure 7:
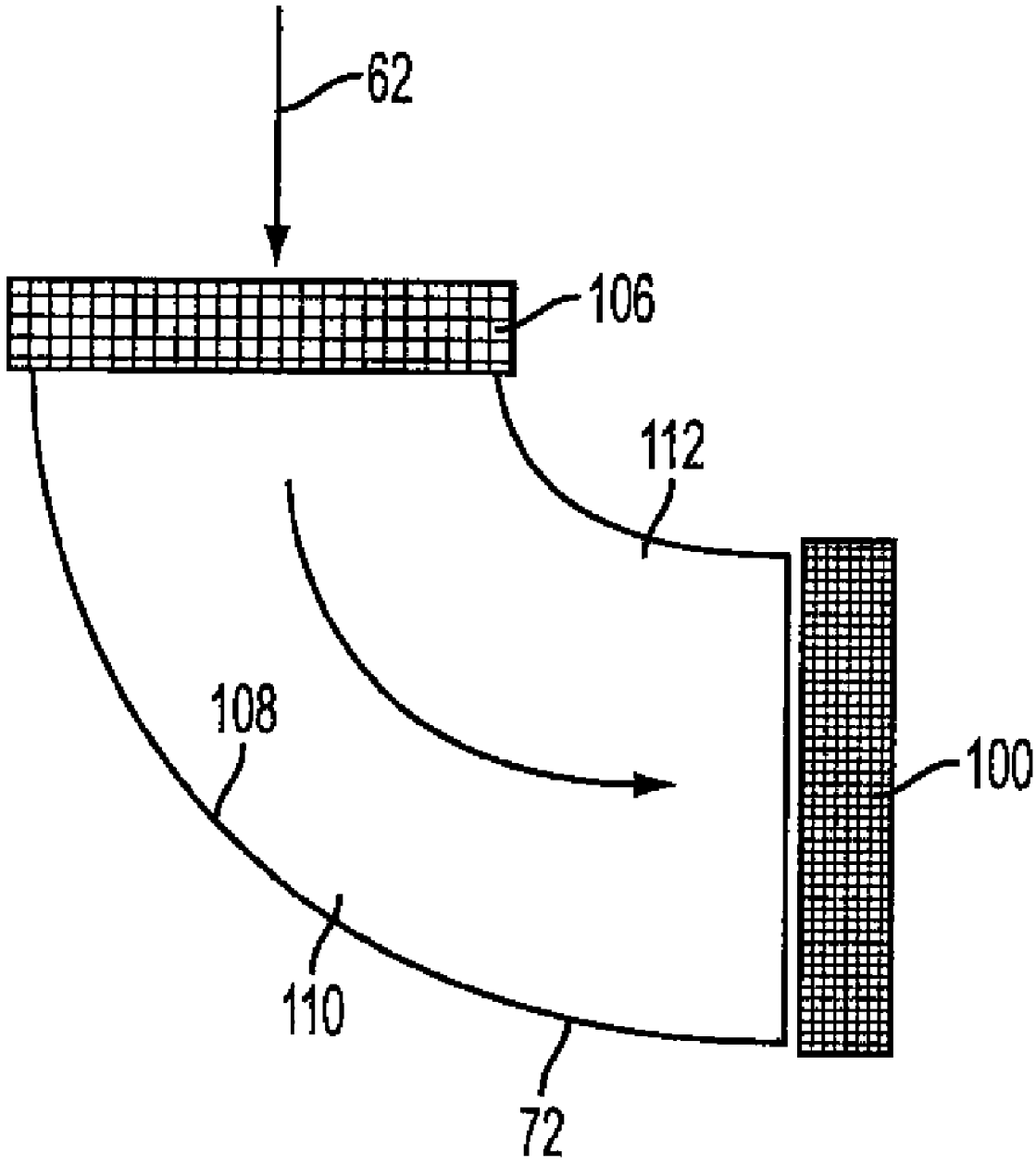
FIG. 7 is a schematic cross-sectional side view of another example embodiment of the present invention including two flow path restrictions.

Referring to FIG. 7, another embodiment of the present invention is shown. Positive pressure gas flow structure 61 of gas flow deflection mechanism 60 includes a curved flow path 108 defined by gas flow duct 72. A positive pressure gas source 92 (shown in FIG. 5) creates a gas flow 62 that follows the curve of curved flow path 108 (from the top left to the bottom right as shown in the figure). Curved flow path 108 includes first flow path restriction 100 and second flow path restriction 106. First flow path restriction 100 is positioned perpendicular to the direction of gas flow 62 and is located at the end of curved flow path 108 opposite positive pressure source 92, and proximate to drop deflection zone 64 (shown in FIG. 5). Second flow path restriction 106 is located in flow path 108 between first restriction 100 and positive pressure source 92. Second restriction 106 is perpendicular to the direction of gas flow 62, but is not parallel to first restriction 100. As such, second restriction 106 reduces turbulence in the gas flow, allowing a substantially laminar flow to follow the curve of curved flow path 108. The curve of flow path 108 is gradual, and therefore does not introduce additional turbulence to the gas flow. However, more gas will be located towards the outside of the curve 110 than the inside of the curve 1 12. First restriction 100 redistributes the gas flow 62 uniformly across the height of gas flow duct 72 resulting in a uniform laminar gas flow across drop deflection zone 64.

Figure 8:
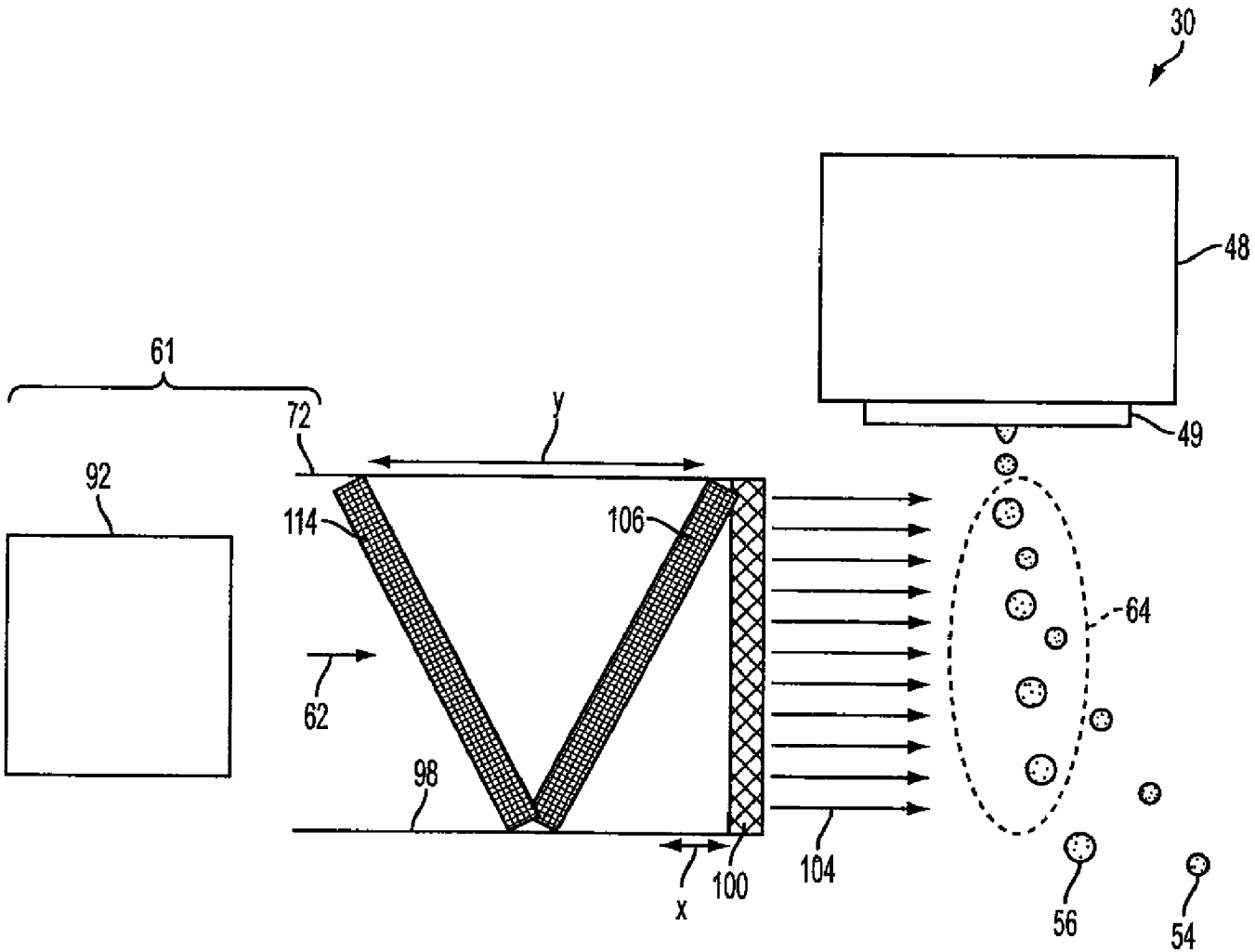
FIG. 8 is a schematic side view of another example embodiment of the present invention including three flow path restrictions.
Figure 9:
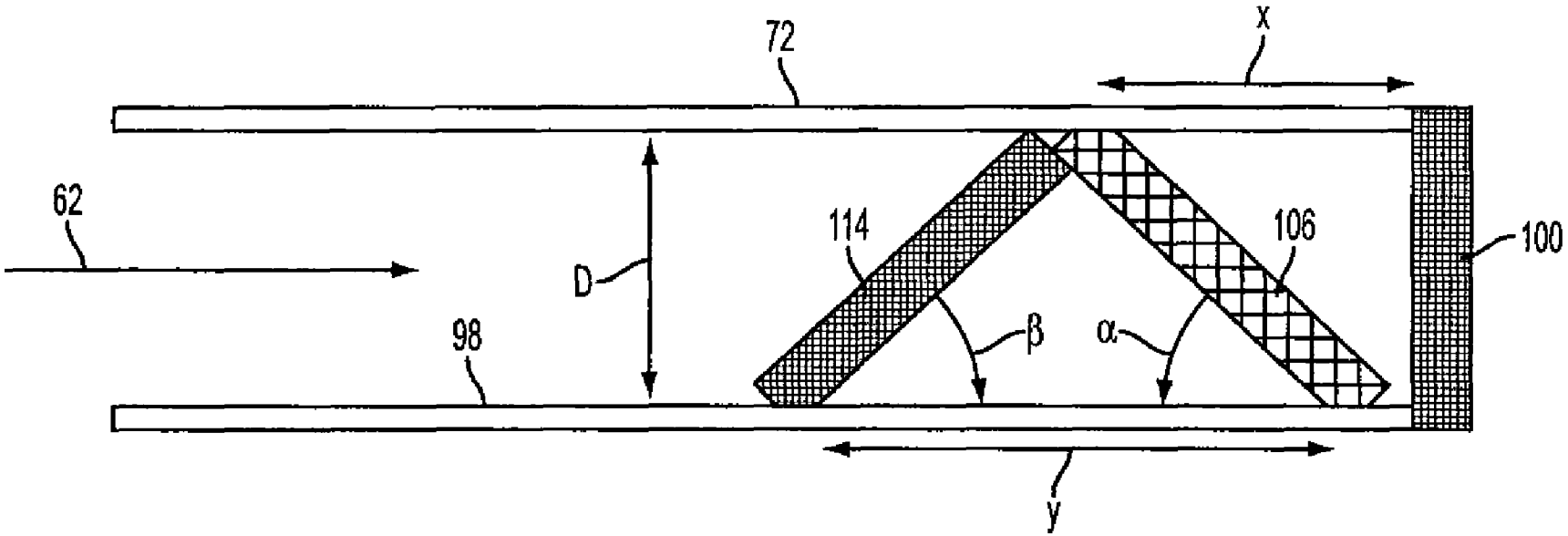
FIG. 9 is a cross-sectional side view of another example embodiment of the present invention including three flow path restrictions.

Referring now to FIGS. 8 and 9, another example embodiment is shown. As shown in FIG. 8, positive pressure gas flow structure 61 of gas flow deflection mechanism 60 includes a flow path restriction 100. Flow path restriction 100 is located at an end of a flow path 98 defined by gas flow duct 72 that is proximate drop deflection zone 64 and spaced apart (or opposite) the end of the flow path 98 that is in fluid communication with or connected to positive pressure source 92. Flow path restriction 100 is positioned perpendicular to the direction of gas flow 62 (represented by arrow 62). Gas flow duct 72 also includes a second flow path restriction 106 and a third flow path restriction 1 14. The positioning or orientation of second flow path restriction 106 and third flow restriction are different when compared to the orientation of first flow path restriction 100 and each other. Laminar gas flow 104 exiting gas flow duct 72 interacts with drops 54 and 56, formed from jetting module 48, in drop deflection zone 64 causing small volume drops 54 to be deflected more than large volume drops 56.

A cross-section of flow path 98 is shown in FIG. 9. Gas flow duct 72 has a height D and a width (extending in and out of the figure) that is preferably approximately equal to or greater than the length of the nozzle array formed in nozzle or orifice plate 49 (also extending in and out of the figure). Gas flow 62 moves from left to right in the figure.

First gas flow restriction 100, second gas flow restriction 106, and third gas flow restriction 114 have different orientations relative to each other. First flow restriction 100 is perpendicular to the direction of gas flow 62 and is located at the end of the flow path 98 spaced apart from gas flow source 92, and proximate to drop deflection zone 64. Second flow restriction 106 is positioned in flow path 98 between first restriction 100 and third restriction 114. Third flow restriction 114 is positioned in flow path 98 between gas flow source 92 and second restriction 106.

Second restriction 106 is oriented at angle a such that second restriction 106 is positioned non-parallel relative to first restriction 100, non-perpendicular relative to gas flow 62, and at a non-parallel, non-perpendicular angle relative to a wall of gas flow duct 72. Third restriction 114 is oriented at angle $\beta$ such that third restriction 114 is positioned non-parallel relative to first restriction 100, non-perpendicular relative to gas flow 62, and at a non-parallel, non-perpendicular angle relative to a wall of gas flow duct 72.

Angles $\alpha$ and $\beta$ are not perpendicular to the direction of gas flow 62, and can be equal (where $\beta$ is $\alpha$) angles, equal and opposite (where $\beta$ is—$\alpha$) angles, or different angles. For example, angles $\alpha$ and $\beta$ can be compound angles. Additionally, second restriction 106 and third restriction 114 can be rotated about different axes. For example, second restriction 106 can be rotated at angle α about a first axis of rotation and third restriction 114 can be rotated at angle β about a second axis of rotation. Angles α and β can be between 30° and 60°. Preferably, angles α and β are between 35° and 55°, and more preferably, angles α and β are 45°.

First restriction 100 and second restriction 106 are separated by a distance X, with X preferably being between one and two times D. Second flow restriction 106 can be positioned such that distance X is located spaced apart from jetting module 48 (at the bottom of gas flow duct 72 as shown in FIG. 5) or proximate jetting module 48 (at the top of gas flow duct 72 as shown in FIG. 6). Alternatively, other orientations can be used depending on the specific application contemplated.

Second restriction 106 and third restriction 114 are separated by a distance Y, with Y being preferably between one and two times D. Third flow restriction 106 can be positioned such that distance Y is located spaced apart from jetting module 48 (at the bottom of gas flow duct 72 as shown in FIG. 9) or proximate jetting module 48 (at the top of gas flow duct 72 as shown in FIG. 8). Alternatively, other orientations can be used depending on the specific application contemplated.

Flow restrictions 100, 106, and 114 are made of a porous material, such as a woven screen or mesh, either metal or polymer. The pores can be located at regular intervals or can be randomly placed, provided that the porosity is relatively uniform across the gas flow duct 72. Fine screen or mesh pores reduce the turbulence more than screen or mesh pores that are coarse. When used as a flow restrictor 100, the screen or mesh pores are typically finer than the pitch of the jets. First, second, and third flow path restrictions 100, 106, and 114 can be made of the same material or different materials depending on the application contemplated. In FIGS. 8 and 9, flow restrictions 100, 106, and 114 are made of a stainless steel screen having approximately 600 lines per inch.

Alternatively, other suitable flow restricting devices or structures, for example, porous plates, foams, and felts, can be used provided they do not cause too large of a pressure drop across the flow restricting device (which reduces the velocity of the gas flow) and do not shed particles (which interferes with drop deflection). Typically, the type of flow restricting device and/or material selection depends on the specific application contemplated.

The invention has been described in detail with particular reference to certain preferred embodiments thereof, but it will be understood that variations and modifications can be effected within the scope of the invention.

PARTS LIST

20 continuous printer system
22 image source
24 image processing unit
26 mechanism control circuits
28 device
30 printhead
32 recording medium
34 recording medium transport system
36 recording medium transport control system
38 micro-controller
40 ink reservoir
42 ink catcher
44 ink recycling unit
46 ink pressure regulator
47 ink channel
48 jetting module
49 nozzle plate
50 plurality of nozzles
51 heater
52 liquid filament
54 small drops
56 large drops
57 drop trajectory
58 drop stream
60 gas flow deflection mechanism
61 positive pressure gas flow structure
62 gas flow
63 negative pressure gas flow structure
64 drop deflection zone
66 small drop trajectory
68 large drop trajectory
72 first gas flow duct
74 lower wall
76 upper wall
78 second gas flow duct
82 upper wall
86 liquid return duct
88 plate
90 front face
92 positive pressure source
94 negative pressure source
98 flow path
100 flow path restriction
102 non-laminar gas flow
104 laminar gas flow
106 second flow path restriction
108 curved flow path
110 outside portion of curve
112 inside portion of curve
114 third flow path restriction

The invention claimed is:

1. A continuous inkjet printhead comprising:

a jetting module including a nozzle, the jetting module being operable to eject a continuous stream of fluid through the nozzle;

a stimulation device operable to break the stream of fluid into a first droplet having a first volume and a second droplet having a second volume, the first and second droplets traveling along a first path;

a drop deflection mechanism that provides a gas flow which interacts with the first and second droplets in a drop deflection zone to cause at least one of the first and second droplets to begin traveling along a second path, the deflection mechanism including:

a structure that defines a gas flow path;

a first flow path restriction positioned along the gas flow path; and a second flow path restriction positioned along the gas flow path, the second flow path restriction being non-parallel relative to the first flow path restriction.

2. The printhead of claim 1, wherein the first flow path restriction is located at an end of the flow path proximate the drop deflection zone and is perpendicular to the gas flow.

3. The printhead of claim 1, the drop deflection mechanism including a gas flow source, wherein the second flow path restriction is located between the first flow path restriction and the gas flow source, and is not perpendicular to the gas flow.

4. The system of claim 1, the gas flow path having a height D, wherein the first flow path restriction and the second flow path restriction are separated by a distance x, where $D \leqq x \leqq 2D$.

5. The system of claim 1, wherein the first and second flow path restrictions include a plurality of pores.

6. The system of claim 1, wherein at least one of the first and second flow path restrictions are one of a metal wire mesh screen and a plastic mesh screen.

7. The system of claim 1, the drop deflection mechanism further comprising:

a third flow path restriction positioned along the flow path.

8. The system of claim 7, the first flow path restriction being located at an end of the flow path proximate the drop deflection zone and is perpendicular to the gas flow, wherein the third flow path restriction is non-parallel relative to the first flow path restriction.

9. The system of claim 7, the gas flow path having a height D, wherein the second flow path restriction and the third flow path restrictions are separated by a distance y, where $D \leqq y \leqq 2D$.

10. A continuous inkjet printhead comprising:

a jetting module including a nozzle, the jetting module being operable to eject a continuous stream of fluid through the nozzle;

a stimulation device operable to break the stream of fluid into a first droplet having a first volume and a second droplet having a second volume, the first and second droplets traveling along a first path;

a drop deflection mechanism that provides a gas flow which interacts with the first and second droplets in a drop deflection zone to cause at least one of the first and second droplets to begin traveling along a second path, the deflection mechanism including:

a structure that defines a gas flow path; and a flow path restriction through which the gas flow passes positioned along the gas flow path, the flow path restriction being located at an end of the gas flow path proximate the drop deflection zone and being perpendicular to the gas flow.

11. The printhead of claim 10, the flow path restriction being a first flow path restriction, the drop deflection mechanism further comprising:

a gas flow source; and a second flow path restriction positioned along the flow path between the first flow path restriction and the gas flow source, and is not perpendicular to the gas flow.

12. A method of deflecting liquid drops comprising:

providing a jetting module including a nozzle;

providing a stimulation device associated with the jetting module;

providing a drop deflection mechanism including:

a structure that defines a gas flow path;

a first flow path restriction positioned along the gas flow path; and a second flow path restriction positioned along the gas flow path, the second flow path restriction being non-parallel relative to the first flow path restriction;

causing the jetting module to eject a continuous stream of fluid through the nozzle;

causing the stimulation device to break the stream of fluid into a first droplet having a first volume and a second droplet having a second volume, the first and second droplets traveling along a first path; and causing the drop deflection mechanism to provide a gas flow which interacts with the first and second droplets in a drop deflection zone to cause at least one of the first and second droplets to begin traveling along a second path.

* * * * *